US009107546B2

(12) United States Patent
Gill

(10) Patent No.: US 9,107,546 B2
(45) Date of Patent: Aug. 18, 2015

(54) TOILET BOWL HYGIENIC CLEANING UNIT

(71) Applicant: Pal Singh Gill, Chesapeake, VA (US)

(72) Inventor: Pal Singh Gill, Chesapeake, VA (US)

( * ) Notice: Subject to any disclaimer, the term of this patent is extended or adjusted under 35 U.S.C. 154(b) by 0 days.

(21) Appl. No.: 13/743,864

(22) Filed: Jan. 17, 2013

(65) Prior Publication Data

US 2013/0192011 A1 Aug. 1, 2013

Related U.S. Application Data

(60) Provisional application No. 61/632,555, filed on Jan. 26, 2012.

(51) Int. Cl.

| | |
|---|---|
| ***B65D 81/24*** | (2006.01) |
| ***A47K 11/10*** | (2006.01) |
| ***A47K 17/00*** | (2006.01) |

(52) U.S. Cl.

CPC ..... *A47K 11/10* (2013.01); *A47K 17/00* (2013.01)

(58) Field of Classification Search

CPC ..... E03D 9/00
USPC ..... 206/361, 209, 209.1, 349, 439, 362.2, 206/362.3, 15.3, 15.2; 220/291, 288, 220/243–245, 248, 251, 255, 253, 820, 821
See application file for complete search history.

(56) References Cited

U.S. PATENT DOCUMENTS

| | | | | |
|---|---|---|---|---|
| 1,193,954 | A * | 8/1916 | Walden | 366/343 |
| 2,351,815 | A * | 6/1944 | Jensen | 312/73 |
| 2,439,978 | A * | 4/1948 | Konchan | 70/455 |
| 2,731,013 | A * | 1/1956 | Holmes | 604/416 |
| 2,780,349 | A * | 2/1957 | Tornberg | 206/533 |
| 3,868,188 | A | 2/1975 | Velardi | |
| 3,968,789 | A | 7/1976 | Simoncini | |
| 4,001,910 | A | 1/1977 | Peilet | |
| 4,211,750 | A * | 7/1980 | Gillespie | 422/123 |
| 4,327,056 | A | 4/1982 | Gaiser | |
| 4,572,376 | A * | 2/1986 | Wrennall | 206/538 |
| 5,419,445 | A * | 5/1995 | Kaesemeyer | 215/11.1 |
| 5,690,214 | A * | 11/1997 | Gaines et al. | 206/209.1 |
| 5,945,076 | A * | 8/1999 | Leonard et al. | 422/300 |
| 5,983,432 | A * | 11/1999 | Jones | 15/21.2 |
| 5,984,555 | A | 11/1999 | Samad | |
| D425,744 | S * | 5/2000 | McGuire | D6/551 |

(Continued)

FOREIGN PATENT DOCUMENTS

WO WO 2008099164 A2 * 8/2008

*Primary Examiner* — Anthony Stashick
*Assistant Examiner* — Jennifer N Zettl
(74) *Attorney, Agent, or Firm* — Ryan S. Osterweil; Day Pitney LLP

(57) ABSTRACT

The base assembly configures side by side drop-in containers; one container for a toilet brush and one container for the cleaning agent. The drop-in features allow easy removal of the brush container to pour out any fluid and for replacement of cleaning agent container as needed. The cleaning agent is preferably a specially formulated, anti-bacterial and environmentally friendly paste which is directly applied to the brush by manually dipping and twisting the brush bristles into the container. Attached to the brush just below the user grip is a round plastic hilt which serves as a cover when the brush is inserted in the container and to suspend the brush bristles above the bottom of the container to allow for drainage. The cover assembly handle, which is attached to the base, can be lifted and rotated to uncover the containers for cleaning operation. The covers are brought back to their original position when not in use.

12 Claims, 6 Drawing Sheets

(56) References Cited

U.S. PATENT DOCUMENTS

| | | | | |
|---|---|---|---|---|
| 6,065,891 | A | 5/2000 | Rehman et al. | |
| D437,659 | S * | 2/2001 | Henry | D28/20 |
| 6,287,037 | B1 | 9/2001 | Hay | |
| 6,364,557 | B1 * | 4/2002 | Dougherty | 401/183 |
| 6,367,621 | B1 * | 4/2002 | Johnson | 206/15.3 |
| 6,368,003 | B1 | 4/2002 | Sorrel | |
| 6,623,201 | B2 | 9/2003 | Brumlik | |
| 6,626,314 | B1 * | 9/2003 | McHenry et al. | 220/254.2 |
| 6,745,427 | B1 * | 6/2004 | Trenz et al. | 15/104.94 |
| 6,769,542 | B2 * | 8/2004 | Polito | 206/361 |
| 7,131,783 | B1 | 11/2006 | DeRoma | |
| D538,437 | S * | 3/2007 | Yue et al. | D24/217 |
| 7,287,295 | B2 | 10/2007 | Treacy et al. | |
| 7,316,046 | B2 | 1/2008 | Michaels et al. | |
| 7,530,138 | B1 | 5/2009 | Platt | |
| 8,209,790 | B1 * | 7/2012 | Garry et al. | 4/255.11 |
| 8,342,321 | B2 * | 1/2013 | McAllan | 206/15.3 |
| 8,484,791 | B2 * | 7/2013 | Lin | 15/104.93 |
| 2008/0209709 | A1 * | 9/2008 | Mayer | 29/426.5 |
| 2012/0266370 | A1 * | 10/2012 | Butter-Jentsch et al. | 4/231 |

* cited by examiner

TOILET BOWL HYGIENIC CLEANING UNIT

BACKGROUND OF THE INVENTION

The present invention of the hygienically cleaning of the toilet bowl provides for the brush and the formulated cleaner on the same base. The cleaner formulation is detergent paste with germicidal properties. Uniqueness of this set-up is to utilize the ability of the brush by a twist to pick up cleaner granules on bristles for start of the cleaning operation. The brush and cleaner combination provides effective, economical and convenient method of cleaning and maintaining sanitary condition of the toilet bowl.

Cleaning the toilet bowl is an unpleasant chore that must, however be done regularly to achieve acceptable sanitary state of the toilet bowl. If not cleaned regularly, hard scale can form from the water-borne minerals can stain the interior of the bowl. Bodily waste can also build up and get stuck on the pitted surface of the bowl and down the goose neck drain. Toilet bowl manufacture has not changed over recent decades. The bowl interior is glazed to get a smooth vitreous surface, however, polishing has not kept with the surface finish technology. Presently available toilet bowl cleaners are composed of harsher and corrosive chemicals that have the potential of pitting the bowl surface and speed up the problem of ugly deposits, a source of infectious bacteria and viruses in the bowl.

Over time, the nature of toilet bowl cleaning has swung from manual to automatic and from disposable swabs to strong chemical fluids. Manual cleaning lends to cleaning with toilet brush to loosen the waste off the bowl surface then flushing the toilet to rinse away the waste. In the process the brush gets contaminated. Simply rinsing the brush does not disinfect it. Automatic cleaners are sold as in-tank or in-bowl and under the rim apparatuses that channel cleaners. It is believed that automatic chemical, acidic or alkaline bowl cleaners, however strong they may be, lacks total effectiveness due to lack of scrubbing; especially older bowls that are stripped of smooth interior surface. In-tank cleaners have also been found to damage tank internals and lack control on cleaner strength and life cycle. Experience has shown that these devices and arrangement are not cost effective.

Over decades, the main cleaning tool available was the toilet brush. The brush was used to scrub off the waste stuck to the inside of the bowl and then flushed to rinse away the waste. Various brush designs have been offered to the consumer without resolving possible contaminant problem. U.S. Pat. No. 6,460,215 B1 claims to reduce time of cleaning but does not deal with brush contamination.

Effort to resolve brush contamination problem resulted in disposable brush head design. Numerous types of disposable swabs or pads designs are known. Manufacture of Swabs or pads of the shape and size requires special equipment. Disposal of swab with every operation adds to the cost of the bowl cleaning. Also swabs, if not properly used, may clog the sewer drain on flushing. Needless to say, every swab design must develop its own disintegration curve for optimum performance. U.S. Pat. No. 4,852,201 discloses a disposable flat biodegradable pad and a specially designed wand an attach and release mechanism on the wand to dispose of the pad before it disintegrates. This has the potential of causing clogging problems.

U.S. Pat. No. 5,471,697 supports a disposable disintegrating cleaning device by being partially dissolved in water in the process of cleaning the toilet bowl. The boot shaped device has greater probability of causing blockage at the goose neck of the bowl drain. As stated earlier, such devices require special equipment to manufacture, package and store in use. U.S. Pat. No. 5,945,076 has tried to combine a brush and fluid cleaner in a rather complex piece of machinery on the premise that a toilet brush is highly unsanitary unless it is dropped back in the same vessel where cleaning fluid is kept. This danger is highly over-rated. Cost and operation of such a machine is inadmissible for residential and commercial use.

Automatic drop-in-tank and other one step cleaners without the use of a toilet brush may be easier to use but does not serve the purpose of sanitizing and cleaning. Effective cleaning needs manual effort with scrubbing pads or toilet brush. A root cause of stains is from mineral build-up seen at the waterline in the toilet bowl and hidden from sight under the rim. This is so because most raw water supply to the homes is high in mineral content. Overtime crusty matter builds up that shows up as stain around the water mark and rim. The crusty surface serves as habitat for microorganisms. Most in-tank cleaners have blue dye as ingredient. Blue water masks the dirt and grime accumulating in the bowl between manual cleaning by brush or effective scrubbers. Such in-tank cleaners may last long but do not claim to clean and sanitize a dirty toilet bowl. Some in-tank cleaners release chlorine bleach from hydrochlorides to disinfect the bowl and discolor the stain. The amount of bleach such cleaners release during flushes depends on the surface exposed to water and temperature of the water. If the bowl is not flushed regularly, chlorine concentration may increase and corrode parts inside the tank. Some plumber manufacturers advise against using such in-tank cleaners. Whatever the constituent of in-tank cleaners, blue color or hydrochloride based, scrubbing with a brush in-between periods to keep up with cleaning chores on the toilets must be done regularly.

Therefore, there is a need for simple yet effective and economical combined cleaning system that is easy to operate and store without the hazards of harsh so and harmful chemicals.

BRIEF SUMMARY

The present art of this invention utilizes a specialty designed brush and cleaner formulated as a paste. This combination is made readily available and manipulated for manual effective cleaning by brush loaded with approximately less than a gram of cleaner. Overall diameter of the frontal end of brush is reduced to service varied designs of toilet bowls. The brush's front end bristles laden with soap granules to clean narrow cavity at the bowl bottom and part of the gooseneck drain that is susceptible to built-up of smudge and contaminants. Also brush handle is so "spooned" to take the brush under the rim scrubbing while loaded with cleaner.

The cleaner is formulated with anti-bacterial properties and odor-killing fragrance with such consistency that will load up on the brush bristles when brush twists and dabs on the cleaner. The result is truly complete hygienically cleaning of the toilet bowl in one step.

BRIEF DESCRIPTION OF THE DRAWINGS

The unique features of this invention are appended in the claims. The invention itself and the assembly of its components and the effectiveness in cleaning the toilet bowl will be self-evident from the brief and later detailed description of the following set of figures:

DETAILED DESCRIPTION OF THE TYPICAL EMBODIMENT

The bathroom is typically furnished with a toilet brush in its container and other cleaning agents in a specially designed lockable bottle specifically designed to clean toilet bowls. Most of these cleaners tend to be harsher chemicals supposedly designed to clean the toilet bowl by the chemical action just by a single spray. Toilet brush is assumed to be dirty and to be used occasionally. Some of the toilet bowl cleaners are advertised as technology enhancement towards automation. These devices and cleaners are expensive to use and not very effective without the manual effort to use the traditional toilet brush. Devices installed in the bowl may get smeared with human excretions and attract bacteria. Over time, use of harsh chemicals is likely to corrode toilet bowl surfaces and are expensive to use. These shortcomings in the present mode of cleaning toilet bowl are addressed in the art of present invention.

Figure 1:
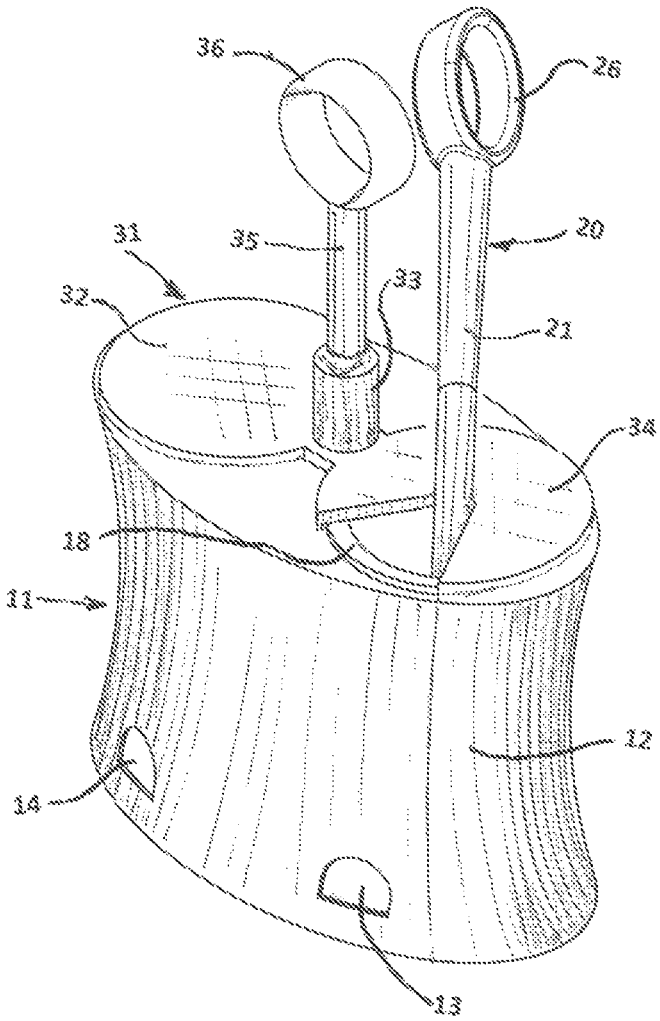
FIG. 1 shows assembled view of all the components drawn in 3D CAD for clarity. Components are identified for detailed explanation of each part of the invention.

FIG. 1 shows 3D sketch of the assembled typical embodiment of the combo-cleaner represented by number 31. Specifically FIG. 1 illustrates the bottom base which houses two containers; one for toilet brush number 20 and the other for cleaner paste located under the soap container cover number 32. The base is rigid, stable and made from suitable plastic material. The shape, size and material of the base may be molded from other materials as long as it is designed to house both the cleaner and the brush readily available for use. Detailed description of all the appurtenances of this assembly will follow.

Figure 2:
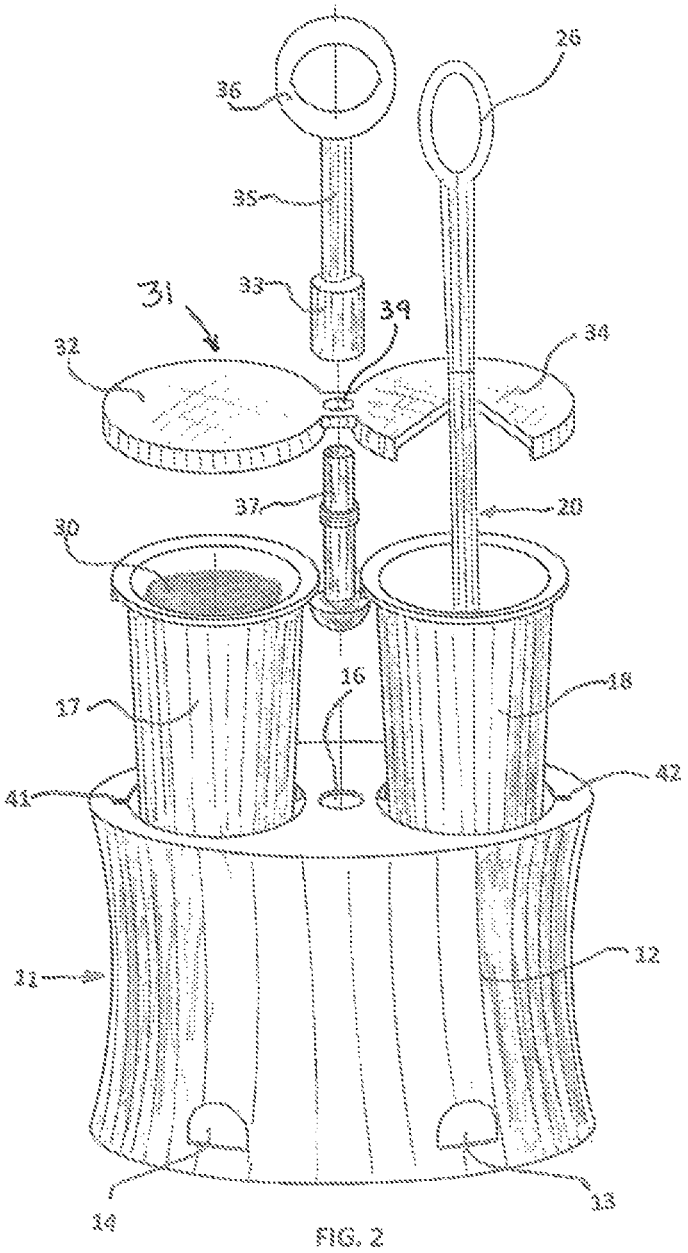
FIG. 2 is another 3D CAD drawing of exploded view of this embodiment with all the components aligned and in place as arranged in the invention.

FIG. 2 shows 3D sketch of the assembly number 11 to expose all the components of the combo-cleaner. As the arrangement shows, the base number 12 serves to hold all components of the assembly as a self-contained unit. Container number 17 contains the cleaner paste number 30 and container number 18 houses the toilet brush number 20. The combined container cover number 31 is shaped to cover, when not in use, container number 17 by circular cover number 32 and container number 18 with circular cover number 34. Circular cover number 34 has a 60 degree sector-cut to accommodate brush number 20 and allow for drying of the bristles. A specially designed bolt number 37 of pre-determined length is inserted from under the hollow base through the hole number 16 and through hole number 39 to thread into internally threaded number 33 of the handle. To use the brush and the cleaner, the cover assembly is lifted up by grip number 36 and slightly twisted and tilted safely remove the brush number 20 by grip 26 from the container number 18. Simultaneously cleaner number 30 is exposed and the brush in manually dipped and twisted in the cleaner paste number 30 to pick up enough cleaner on the brush bristles to clean the toilet bowl. It is recommended that the brush will be used more often with cleaner than otherwise, especially after frequent use of toilet.

Figure 3:
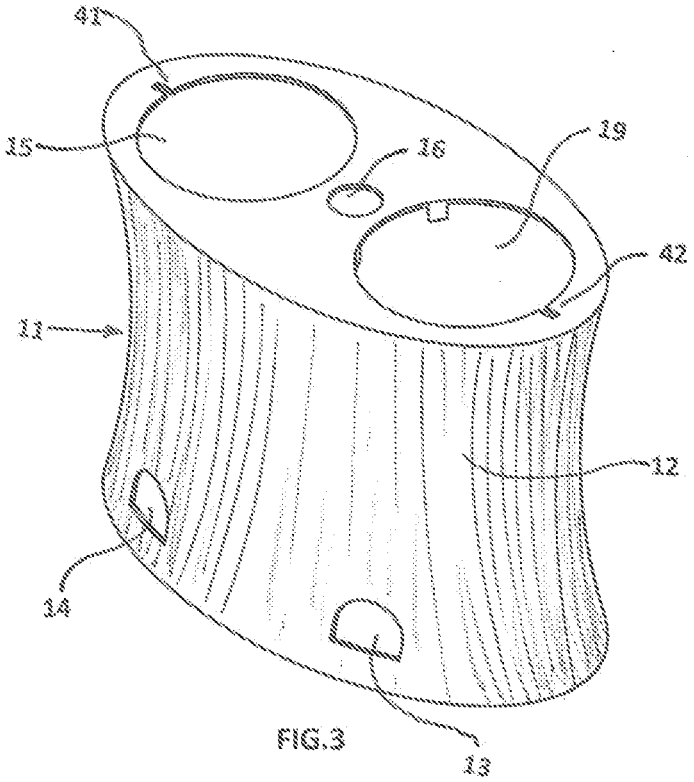
FIG. 3 shows 3D CAD drawing of the base that houses the most important cleaning components of this invention.

FIG. 3 shows the base number 11 which houses the entire the combo-cleaner assembly. The shape and the size of the embodiment number 12 does not preclude the shape, size and other arrangements of the cleaner components for ready availability of toilet brush and cleaner, which is essentially a paste to be swept up by the twist of the toilet brush. The material of construction is basically household plastics or any other material suitable for bathroom environment. The base number 11 shows an attractive elliptical shape with two openings number 15 and number 19 for the cleaner and brush containers respectively. Hole number 16 is sized for bolt number 37 to pass thru up to slotted round head. The notches numbers 41 and 42 are for positioning of the containers numbers 15 and 19 to avoid twisting of the said containers. Opening numbers 13 and 14 with identical openings on the opposite side are to lift up the cleaner and the brush containers as and when deemed necessary for replacement.

Figure 4:
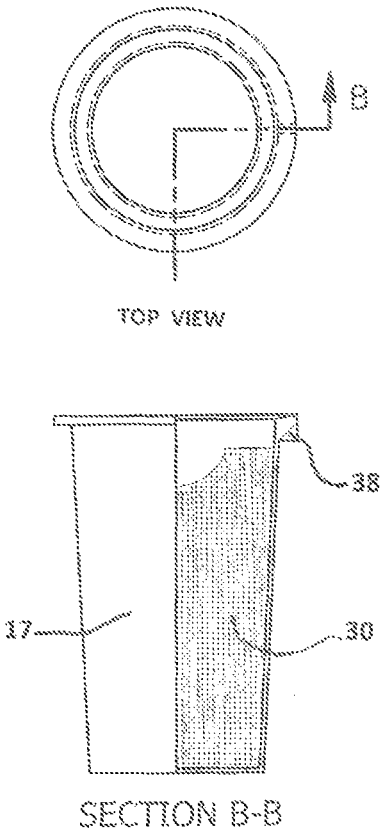
FIG. 4 shows 2D CAD drawing of container that contains cleaner in the form of paste. SEC. B-B shows cleaner profile. Cleaner is a paste of anti-bacterial detergent with fragrance.

FIG. 4 shows number 17, a standard plastic container of designed capacity for containing cleaner paste number 30, shown here by sec. B-B with a starter dip formed into the paste. The container has a lip and a wedge number 38 to insert into the base opening number 15 and notch 41 for location.

Figure 5:
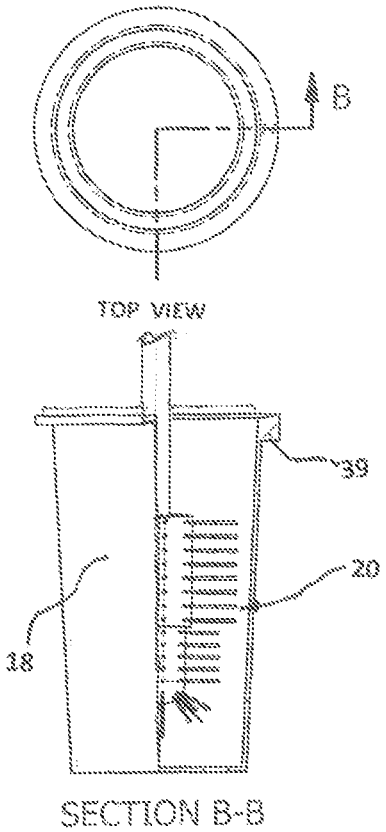
FIG. 5 shows 2D CAD drawing of toilet brush container. Section B-B shows brush hung above the bottom of the container to prevent contact with water drained from the brush after use.

FIG. 5 Shows number 18, a standard plastic container of designed to hold brush number 20 when not in use. Sec. B-B shows the toilet brush in place. The container has a lip and a wedge number 39 for insertion into base opening 19 into notch 42 for location.

Figure 6:
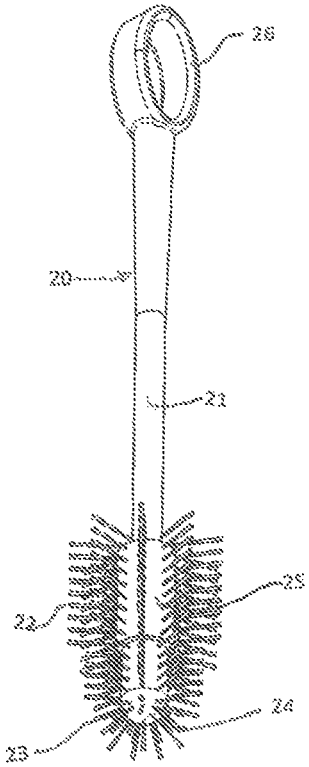
FIG. 6 shows the 3D CAD drawing of toilet brush. Brush distal end has 2 spools, bottom being the smaller diameter than the upper spool. Spools are furnished with regular tough quality nylon bristles of predetermined length.

FIG. 6 shows 3D sketch of a specially designed two-stage brush number 20. The frontal end number 23 is designed narrow to clean soiled spots into the gooseneck drain opening of the toilet bowl. Bristles number 24 are comparatively smaller in length than the upper part of the brush design. The upper part of the brush, designated by the reference numeral 25, is of slightly larger diameter with typical tough nylon bristles, designated by the reference numeral 22. Material of construction of the brush stem number 21, grip number 26 is household plastic. Overall length of the brush is designed for greater maneuverability around the bowl configuration including under the rim. Toilet brush sizing at the bristles will allow insertion to just above the bottom of the container to promote drying of the bristles.

Figure 7:
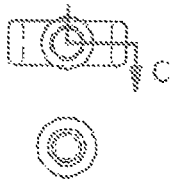
FIG. 7 shows the orthographic illustration of the specially shaped threaded bolt with round head. It forms the bottom part of the handle which is attached to the base and is threaded to the upper portion of the handle.
Figure 7:
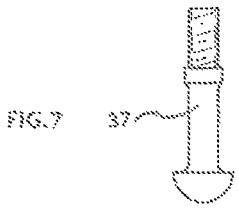

FIG. 7 is a specially designed bolt number 37. It is threaded at one end with a round head. Length of the bolt will vary with the design parameters of the handle number 35. Material of construction is suitable solid plastics.

Figure 8:
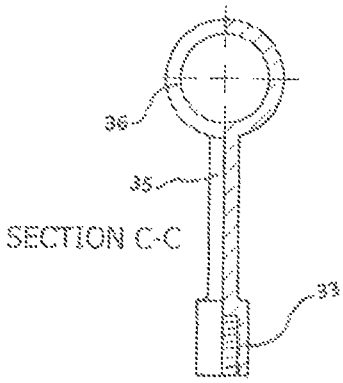
FIG. 8 is the orthographic illustration showing the upper part of the handle that holds the cover assembly together. It is provided with a grip to carry the assembly and to rotate the covers as needed.

FIG. 8 shows handle number 35 with grip 36. Sec. C-C shows larger diameter number 33 of the distal end to show internal threads.

Figure 9:
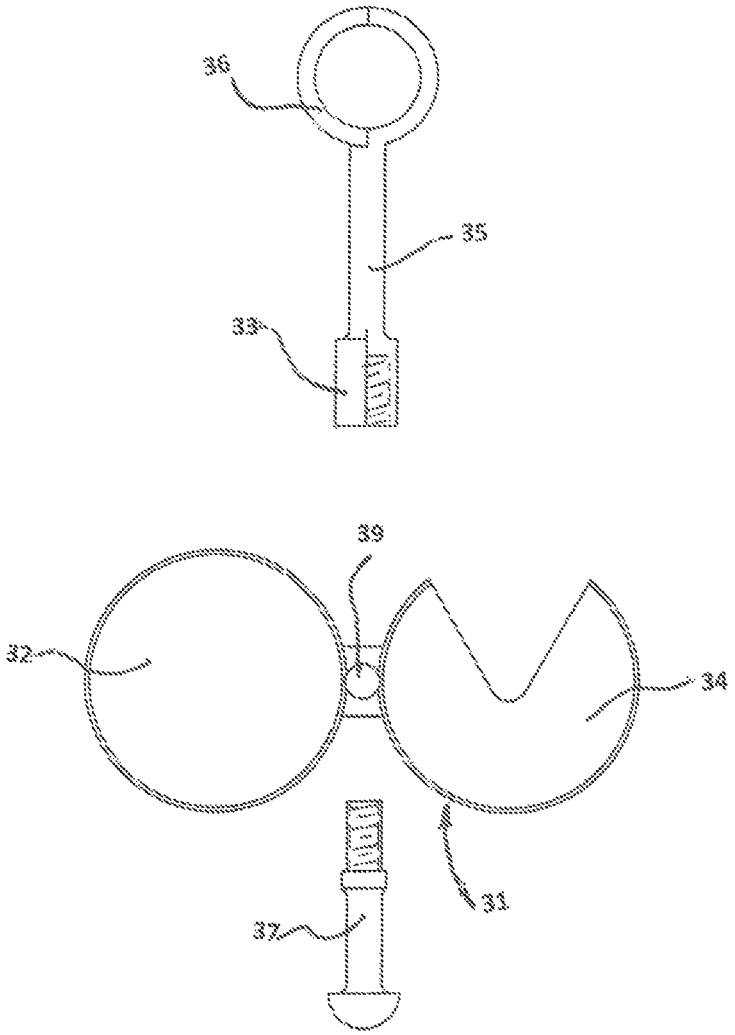
FIG. 9 is the orthographic view of the cover assembly and its relation to the handle assembly.

FIG. 9 is one single piece cover bottom view with one side a circular disc to cover cleaner container completely and the other side a sector shaped disc to partially cover the brush container. The entire assembly is constructed by screwing the bolt passing through hole 39 and screwed in number 33. All the part numbers are arranged as shown on the exploded view and ready to assemble in place. Material of construction is standard household plastics.

The idea behind this invention is to replace a singular toilet brush with a toilet brush and cleaner paste side by side assembly for convenience and economy.

The invention claimed is:

1. A toilet bowl hygienic cleaning unit comprising:

a base, said base having two cavities therein;

two containers, said containers set within respective cavities, one container containing therein a cleaning solution, the other container containing a brush member a cover assembly, said cover assembly covering the top of both of said containers; the cover assembly being simultaneously rotatable across the tops of the two containers when lifted off of lips of the two containers;

a handle, said handle affixable to said cover assembly, said cover assembly rotatable with said handle;

the brush member being adapted to scrub the interior of the bowl with a combination of brush and cleaner; and the brush member being adapted for regular and repeated cleaning and maintaining of the toilet bowl in a hygienic state.

2. The toilet bowl hygienic cleaning unit according to claim 1, wherein said base has a plurality of notches therein, said notches arranged to support the bottoms of a radial lip of said containers within said cavities, said containers set therein and supported in the cavities by said radial lip on the containers and a protrusion under the lip being mated to the notch to prevent rotation.

3. The toilet bowl hygienic cleaning unit according to claim 1, wherein said cleaning unit has at least one lip portion that mates with at least one notch portion along a rim of at least one of said cavities to hold the containers in place and wherein the cover assembly is capable of moving up and down along a vertical axis of the handle and capable of rotating 360° when pulled up.

4. The toilet bowl hygienic cleaning unit according to claim 1, wherein a cover portion of said cover assembly containing said brush member has a wedge portion there through, the wedge portion narrowing in the center of the cover to hold and suspend a brush member in the container to drip and dry.

5. The toilet bowl hygienic cleaning unit according to claim 4, wherein said brush member is adapted to be suspended within the respective container when positioned in said wedge portion to drain the brush member dry, and wherein the dry brush, when dipped in the container containing the cleaning solution, will not dilute and compromise the cleaner strength.

6. The toilet bowl hygienic cleaning unit according to claim 1, wherein said brush member has a first head part and a second head part, said first head part having a plurality of first bristles thereon, and said second head part having a plurality of second bristles thereon, said second head part being at a terminal end of said brush member.

7. The toilet bowl hygienic cleaning unit according to claim 6, wherein said second head part has a smaller diameter than said first head part, and wherein the second head is rounded at the terminal end.

8. The toilet bowl hygienic cleaning unit according to claim 6, wherein said second bristles are different from said first bristles, whereby said second bristles are configured to conform to inner portions of said toilet bowl and wherein the second bristles are smaller in length than the first bristles, thereby the overall diameter of the second head part of the brush member is configured to conform to inner portions of the toilet bowl.

9. The toilet bowl hygienic cleaning unit according to claim 1, wherein said cleaning solution is a paste of adaptive range of viscosity at room temperature suitable to lace the brush bristles prior to the cleaning operation.

10. The toilet bowl hygienic cleaning unit according to claim 1, wherein said cleaning solution is formulated from the group consisting of environmentally friendly cleaners with disinfectant/anti-bacterial properties, odor-killing fragrances, and combinations thereof.

11. The toilet bowl hygienic cleaning unit according to claim 1, further comprising:

a cover assembly bolt, said bolt passing through a hole in said base and through a hole through said cover member, and secured at one end to a threaded member of said handle, said threaded member being adapted to be tightened to fix said cover member atop said containers, and said cover member being rotatable about an unthreaded portion of said bolt when lifted off of lips of the two containers.

12. The toilet bowl hygienic cleaning unit according to claim 1, wherein the cover assembly is adapted to lift and rotate to expose both the brush and the cleaner containers simultaneously;

wherein the brush is adapted to dip and twist in the cleaner container to loading the brush bristles with cleaner;

wherein the brush is adapted for scrubbing the interior regions including the rim and front of a gooseneck drain prior to flushing the bowl to complete cleaning operation; and wherein the brush is adapted to shake off excess fluid inside the bowl before suspending the brush back in its designated container to drip and dry.

* * * * *